US010226875B2

(12) United States Patent
Newman et al.

(10) Patent No.: US 10,226,875 B2
(45) Date of Patent: Mar. 12, 2019

(54) CAKE CUTTING TOOL

(71) Applicants: Cynthia Newman, Minneapolis, MN (US); Kathleen Doris, St. Paul, MN (US)

(72) Inventors: Cynthia Newman, Minneapolis, MN (US); Kathleen Doris, St. Paul, MN (US)

( * ) Notice: Subject to any disclaimer, the term of this patent is extended or adjusted under 35 U.S.C. 154(b) by 347 days.

(21) Appl. No.: 14/016,386

(22) Filed: Sep. 3, 2013

(65) Prior Publication Data

US 2014/0068949 A1 Mar. 13, 2014

Related U.S. Application Data

(60) Provisional application No. 61/699,412, filed on Sep. 11, 2012.

(51) Int. Cl.
*B26B 27/00* (2006.01)

(52) U.S. Cl.
CPC ..... *B26B 27/002* (2013.01)

(58) Field of Classification Search
CPC ..... B26B 27/002; A21C 15/04
USPC ..... 30/114, 115, 116, 117; 83/932; 132/325
See application file for complete search history.

(56) References Cited

U.S. PATENT DOCUMENTS 1,454,429 A * 5/1923 Dresser ..... A61C 15/043 132/325
2,158,667 A * 5/1939 Rieck et al. ..... 83/157
2,403,190 A 7/1946 Parraga
2,759,261 A * 8/1956 Setecka ..... 30/116
2,964,844 A * 12/1960 Steward et al. ..... 30/116
3,089,371 A 5/1963 Spears
3,310,082 A * 3/1967 De La Tramerye ..... 30/502
3,766,817 A 10/1973 Aby et al.
4,398,347 A * 8/1983 Duffy ..... 30/90.1
4,574,478 A * 3/1986 Persyk et al. ..... 30/116
4,995,153 A * 2/1991 Asbery ..... 30/116
5,159,943 A * 11/1992 Richards ..... A61C 15/045 132/321
5,617,634 A * 4/1997 Moesmann ..... 30/116
6,647,848 B1 11/2003 Bruner
6,701,620 B2 * 3/2004 Huang ..... 30/116
2005/0278957 A1 12/2005 McCullough
2007/0214649 A1 * 9/2007 Hess ..... 30/116

* cited by examiner

*Primary Examiner* — Omar Flores Sanchez
(74) *Attorney, Agent, or Firm* — Global Intellectual Property Agency, LLC; Daniel Boudwin

(57) ABSTRACT

A cake cutting spool is provided for a user to dispense lengths of cutting thread therefrom and for cutting a cake in straight segments. The spool comprises a circular housing having a central spindle, an outer sidewall, and a securable door for retrieving and separating lengths of cutting thread. The cutting thread comprises a series of thread segments removably connected to one another and wound around the spindle, wherein each segment includes a first handled end and a second free end. The handled end includes a pull tab, which allows a user to grasp the thread segment and pull the free end thereof through the cake after a cutting procedure without lifting the thread through the cut line. This allows for straight line cutting and no sticking of the cake batter or icing to the tool after the cut is made, whereafter the utilized cutting thread is disposable.

5 Claims, 3 Drawing Sheets

CAKE CUTTING TOOL

CROSS REFERENCE TO RELATED APPLICATION

This application claims the benefit of U.S. Provisional Application No. 61/699,412 filed on Sep. 11, 2012, entitled "Quickie Cake Cutter." The above identified patent application is herein incorporated by reference in its entirety to provide continuity of disclosure.

BACKGROUND OF THE INVENTION

Field of the Invention

The present invention relates to cutting tools for cakes and confectionary items. More specifically, the present invention relates to a spool of cutting thread adapted to dispense in lengths, whereby the cutting thread is designed for cutting cake without disrupting the icing design or the structure of the cake when creating individual slices thereof.

Cakes are baked pastry items that are typically consumed during parties, birthdays, weddings, and other celebratory events. Typical cakes are bread-like food items having an icing or pastry frosting exterior. The cake can be stacked between different layers of icing or filler, while the exterior generally has a coating of icing and a design to commemorate the event.

Cutting a cake is a straight forward task that can be accomplished using a knife or pie-cutting utensil. However, cutting cakes into neat, individual slices that retain the layered structure of the cake without destroying its shape is more difficult. Most often the cake layers will stick to the cutting tool when the user attempts to retrieve the tool after making the cut. This causes the layers to separate and the cake to lose its form, or even spill over and create a mess. Furthermore, cutting a cake using a short cutting implement, such as a knife or pie cutter, does not guarantee successfully creation of equal divisions or straight line patterns.

The present invention is herein provided to solve these known issues in the art of cake cutting and dispensing. Specifically, a spool of cutting thread is provided, wherein removable lengths of cake cutting thread are wound within a spool and dispensed therefrom. The individual lengths are separable from the spool to provide a user with a cutting thread having a tabbed first end and a free second end. The tabbed end of each length serves as a pull tab to pull the free end of the cutting thread through the cake after the thread has been used to cut a straight line down through the cake layers. The dispensed length of cutting thread is then disposed of, and the spool is closed for later use. Overall, the device provides a dispensable spool of cutting thread for use in cutting cakes.

Description of the Prior Art

Devices have been disclosed in the prior art that relate to cutting tools and thread cutting devices. These include devices that have been patented and published in patent application publications. The following is a list of devices deemed most relevant to the present disclosure, which are herein described for the purposes of highlighting and differentiating the unique aspects of the present invention, and further highlighting the drawbacks existing in the prior art.

There exist devices in the prior art that relate to food product and cake cutting tools, including those that utilize thread as the cutting implement. However, most of these relate to larger assemblies for cutting lengths of items on a large board, or are directed to tools for specific cake geometries. The present invention pertains to a cutting implement spool and dispensing structure that is useful for neatly cutting and preparing individual slices of a cake, where the cake can be sheet cake, layered cake, or any similar pastry or confectionary items where presentation is important.

One such device in the prior art is U.S. Pat. No. 6,647,848 to Bruner, which discloses a cake layer cutting apparatus that allows a user to slice through a cake in horizontal planes accurately and evenly. The apparatus comprises a pair of supports and a handle portion bridging the two supports. Below the handle is a plurality of wires drawn tight between the supports by a rotatable axle, which tensions the wires for the user to draw them through a cake for a slicing procedure. The user grabs the overhead handle and pulls the apparatus across the cake, wherein the tensioned wires cut the cake along horizontal planes. While disclosing a cake cutting device using wire cutters, the Bruner device is limited to cutting horizontally and is not suited for creating individual slices, which is the primary function of the present thread cutting tool.

Another such device is U.S. Pat. No. 3,766,817 to Aby, which discloses a slicing device that is useful for cutting various foods using a wire cutting element. The device comprises a base forming a flat cutting surface, and a wire cutting element mounted to a U-shaped bar that is attached to the base. A handle at the end of the bar is rotatable therefrom and supports an end of the wire cutting tool. When cutting, the bar is rotated away from the board, as is the handle, which tensions the wire and draws it downward onto the cutting surface. Articles thereon are cut into slices by the wire cutting element. While providing a wire cutting tool, the Aby device requires the wire cutting element to be drawn through a food product, and then pulled back through the same channel in the food as the wire created. In cakes, this causes the icing and the cake itself to be drawn with the wire, causing the cake to separate or become messy. The present invention contemplates lengths of cutting thread that are pressed downward on a cake, and then a free end of the thread is drawn through the cake from the base and outward therefrom, eliminating this concern of the prior art.

Finally, U.S. Pat. No. 2,403,190 to Parraga discloses a cake cutting device that is adapted to cut circular cakes, wherein a circular frame is provided that supports a length of wire strung thereon to create a plurality of equally spaced, radial cutting elements that create individual cake slices when the frame and cutting elements are forced downward onto the cake. A pair of crossing, U-shaped handles is removably disposed above the planar ring, allowing the user to press thereon to draw the cutting elements through the cake and the frame around the circular geometry of the cake. Similar to the Aby device, the Parraga device suffers from an inability to remove the wire cutting elements without destroying or disrupting the cake. The Parraga device does not allow the user to remove the frame or cutting wires without drawing the assembly through the cut cake. The present invention eliminates this draw back by providing a singular length of cutting thread with a free end, the free end being slidable through the already cut cake after the slicing action has finished.

The present invention is a new and novel means of cutting cake into individual proportions without destroying the structure of the cake layers or the icing during the process. The device includes a spool having dispensable lengths of cutting thread that are adapted to be utilized in cutting through cake and being pulled therethrough without lifting the thread through the newly created cut. This allows the icing and cake batter to be separated without tugging or separating the layers when retrieving the cutting implement, which commonly occurs when cutting a cake. Overall, the device provides a disposable cutting thread for improving the process and the final results of cutting cake into portions.

It is submitted that the present invention is substantially divergent in design elements from the prior art, and consequently it is clear that there is a need in the art for an improvement to existing cake cutting tools. In this regard the instant invention substantially fulfills these needs.

SUMMARY OF THE INVENTION

In view of the foregoing disadvantages inherent in the known types of cake cutting tools now present in the prior art, the present invention provides a new assembly that can be utilized for providing convenience for the user when dispensing lengths of cutting thread having a defined structure for cutting cake and thereafter removing the tool from the cake without ruining the aesthetics thereof.

It is therefore an object of the present invention to provide a new and improved cake cutting tool that has all of the advantages of the prior art and none of the disadvantages.

It is another object of the present invention to provide a cake cutting tool that provides disposable cutting thread for one-occasion use, whereafter the length of utilized cutting thread is disposed of in favor of a freshly dispensed length thereof.

Another object of the present invention is to provide a cake cutting tool that provides a user with the ability to easily cut straight lines into a cake and remove the tool after the cut has been created, whereby the cake layers and icing is not disturbed after the cutting process.

Yet another object of the present invention is to provide a cake cutting tool that can be utilized in a domestic or commercial setting, and for informal or formal gatherings where cake is served and efficiency and neatly proportioning the cake into slices is required.

A final object of the present invention is to provide a cake cutting tool that may be readily fabricated from materials that permit relative economy and are commensurate with durability.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
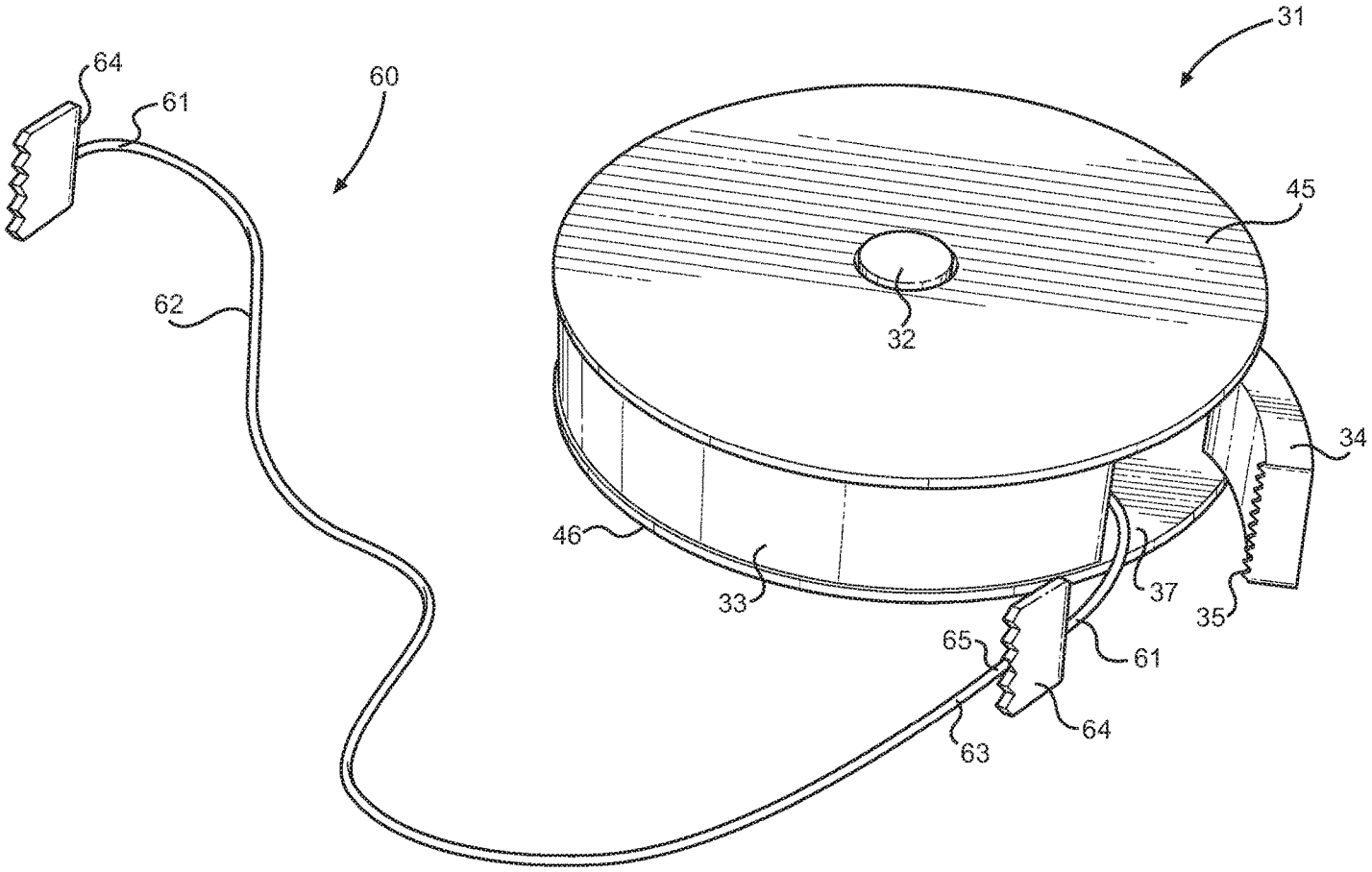
FIG. 1 shows a perspective view of the cake cutting tool of the present invention in an open and dispensing state.

Reference is made herein to the attached drawings. Like reference numerals are used throughout the drawings to depict like or similar elements of the cake cutting tool. For the purposes of presenting a brief and clear description of the present invention, the preferred embodiment will be discussed as used for cutting cake and other pastry items into neat segments, whereby the tool allows for straight line cuts and for retrieval of the tool after the cut is made. The figures are intended for representative purposes only and should not be considered to be limiting in any respect.

Referring now to FIG. 1, there is shown an overhead perspective view of the present invention. The device comprises a spool assembly 31 that supports a wound length of cutting thread 60 about a central spindle 32. Cutting thread 60 is an assembly of thread lengths temporarily attached to one another in an elongated fashion, whereby retrieving one length of thread 62 draws a second length from the spool 31. An individual, exposed length 62 of thread is then separated from the spool 31 for use as a cake cutting implement. It is desired to disclose a new and novel cake cutting tool that can be provided as a complete assembly, or alternatively as a replenishable tool having an accessible interior volume that permits replacement thread 60 to be placed within the spool 31 and about the spindle 32 when the thread has been consumed. The thread lengths 62 are disposable after their use with a single cake, wherein subsequent lengths can be withdrawn for different events or on occasions where a fresh length of cutting thread is desired.

The spool 31 comprises a circular housing having an upper 45 and lower 46 surface and a perimeter sidewall 33 therebetween. The housing provides an interior volume that supports a spindle 32 within the center thereof, which is adapted to support the wound length of cutting thread 60 within the housing. Along a portion of the sidewall 33 is a doorway 37 that allows a user to retrieve individual lengths 62 of thread from within the housing. A hinged door 34 controls access within the housing, and further provides a means to separate the individual lengths 62 of thread.

The hinged door 24 maintains the tangential curvature of the sidewall 33 and provides coverage for the housing opening 37. When retrieving a length 62 of thread, the door 34 is opened, a length 62 is retrieved. As the subsequent length of thread is revealed, the door 34 is utilized to stabilize this subsequent length as the user pulls the exposed length 62 therefrom. The pulling action causes the lengths to separate as door 34 depresses the length of thread behind the exposed length 62. To assist this process, a length of gripping teeth 35 or serrated teeth can be disposed along the distal end of the door 34 and along the interior surface thereof. This assists in gripping the thread length from one side while separating an exposed length thereof for use as an independent cutting tool.

The individual cutting thread lengths 62 comprise a first handled end 61 and a second, free end 63. The first end 61 includes a pull tab 64 that is utilized in the cake cutting process and in the thread retrieval process. The free second end 63 of the thread length 62 is adapted to be temporarily attached 65 to a first end 61 of a subsequent length of cutting thread within the spool. In this way, the lengths 62 are attached while in the spool housing and can be retrieved in order by the user, whereby one length is exposed, separated, utilized, and then replaced by another length that has been partially exposed by the first length.

Figure 2:
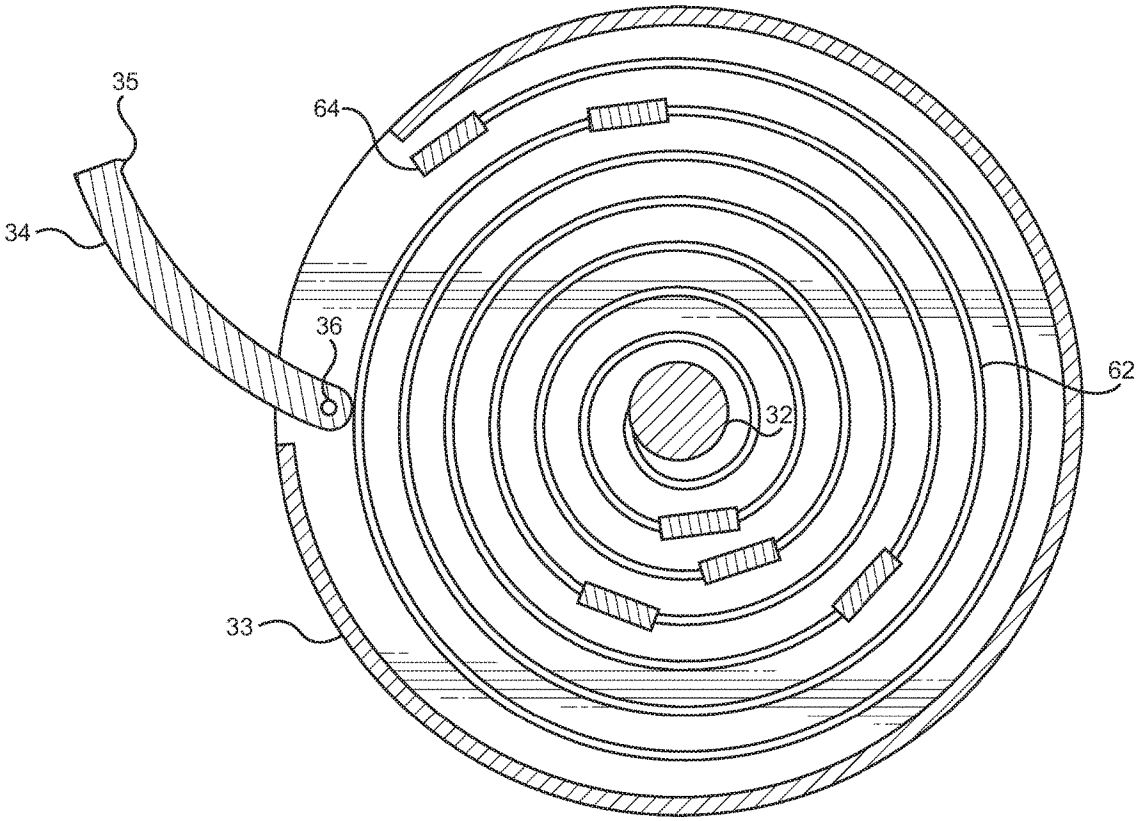
FIG. 2 shows an overhead cross section view of the present invention.

Referring now to FIG. 2, there is shown an overhead cross section view of the spool and cutting thread assembly of the present invention. As visualized, the spool housing includes an open interior and a central spindle 32 therein. A wound coil of cutting thread is disposed about the spindle 32 and within the rounded sidewalls 33, whereby the cutting thread is connected in defined lengths 62 for individual dispensing through the sidewall door 37. When retrieving a length 62, the door 34 is opened to expose a pull tab 64 of the next cutting thread length in line to be dispensed. That length is drawn through the opening 37 and exposed from the spool housing. The gripping teeth 35 on the door 34 and the ability to pinch the thread using the door 34 allow a user to separate the exposed length from the rest of the wound thread within the spool housing. The door 34 pivots about a hinge pin 36, which allows the user to open the door 34 and close the same onto a subsequent thread length as a user separates an exposed length extending therefrom.

Figure 3:
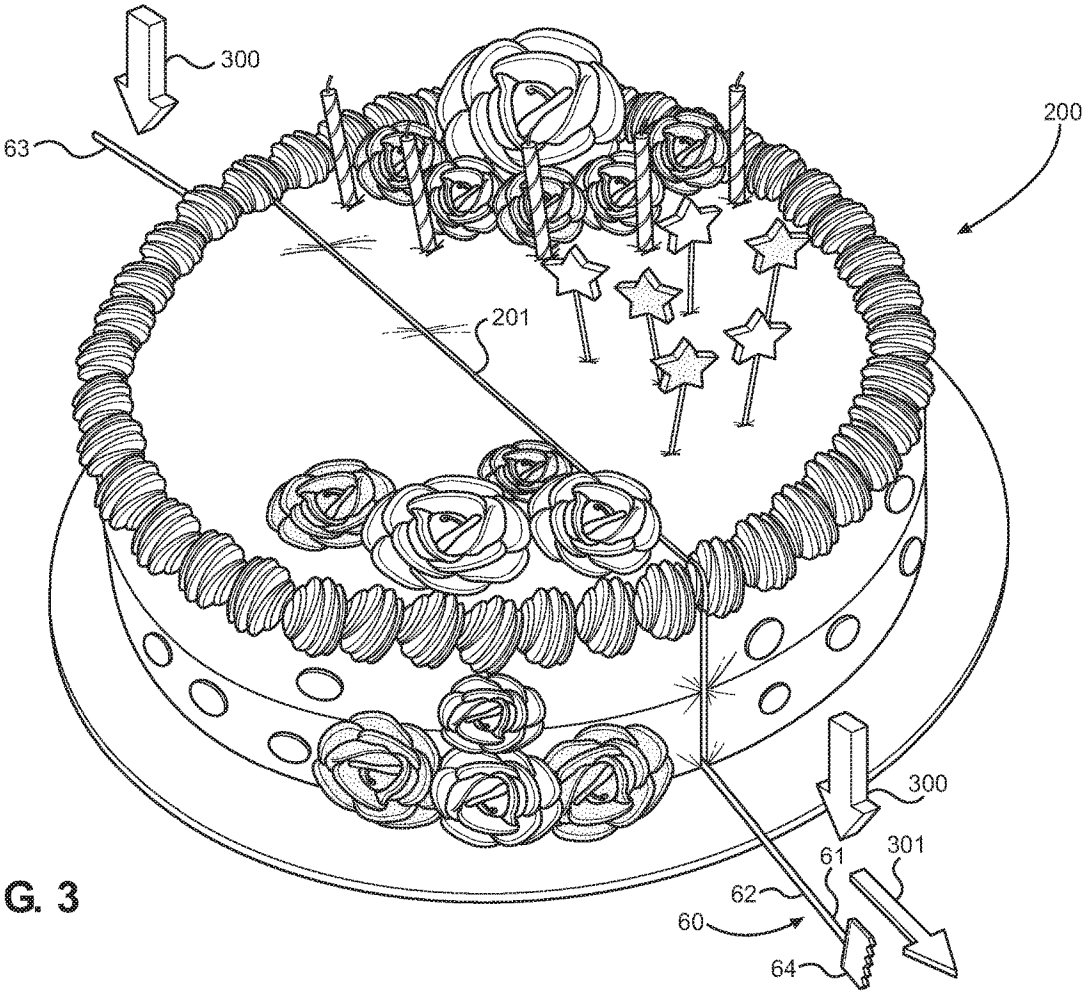
FIG. 3 shows a view of the cake cutting tool in a working state, cutting a cake in straight lines and thereafter being retrieved without disturbing the cake batter or icing.

Referring now to FIG. 3, there is shown a view of the cutting thread of the present invention in a working state, cutting a cake into individual segments while not disrupting the look or structure of the cake layers in the process. In use, the individual cutting thread length 62 is grasped with two hands, one at the first end 61 and one at the second end 63 thereof. The user tensions the thread length 62 over the cake 200 and positions the tensioned thread over a location in which a straight cut is desired. The user then depresses the tensioned thread downwards 300 through the cake icing and all of its layers.

At this point, a planar cut has been made through the cake. However, after this point is generally where the cake can become damaged. Using a utensil to cut the cake is easily accomplished, however the cake batter and icing generally sticks to the utensil item after the cut is made, making retrieval of the utensil from within the cake interior very problematic. The cake layers stick to the utensil as the user pulls the utensil from the cake, drawing the cake with it and causing separation and tipping over of the layers and smearing of the icing. This is not ideal for serving freshly cut cake at an event, where presentation is valued.

Using the cutting thread of the present invention, once the cut is made through the cake, the cutting thread length 62 is positioned against the bottom of the cake or its supporting plate. Rather than drawing the thread through the created cut plane, the user simply pulls on the first end 61 of the thread length 62 and draws the second end 63 through the cake and away 301 therefrom. The second end 63 will not snag or draw with it any icing or batter, creating a clean cut line 201 through the cake 200. The procedure can be repeated many times to create individual slices and segments of the cake. The use of the cutting thread improves efficiency of cutting, improves the aesthetics of the cut and the served slice, and further allows for finer cuts and smaller cake segments to be cut, where otherwise a thick utensil would simply mash or crumble the cake rather than separate the same.

As consumers, we generally use knives and other utensils to cut a cake. This can sometimes ruin the cake during the utensil retrieval process, as the frosting adheres to the utensil, or the utensil is not the correct length to cut across the entire cake. This makes a mess of the cake and the individual slices. The present invention comprises a wound length of cutting thread and a spool housing for dispensing the same. The thread is ideally dispensed in equal lengths, however varying length spools are contemplated within the present invention.

Overall, the assembly provides a tool for cutting a cake without using knives or utensils that would otherwise ruin the frosting design. The individual lengths are preferably for single-use only, wherein a cake is cut with the same cutting thread length, and thereafter the length is disposed of. Contemplated material for the cutting thread includes any sanitary thread that can be manufactured to have trimmed sections between the free end of one length and the handled end of a subsequent thread length. The thread also has be strong enough to be tensioned by the user during the cake cutting procedure, whereafter the thread is not an environmentally hazardous material when disposed of. The thread is preferably made from any one of the following material: monofilament, polymer, cotton, nylon, metal, or another suitable material thread length material. Finally, the spool housing of the present invention may comprise a static structure, or may further comprise a structure that includes a removable upper or lower surface for accessing the interior volume therein for replacing the wound cutting thread with a replacement length thereof.

It is submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A cake cutting tool, comprising:

a spool housing having an upper and lower surface, a perimeter sidewall, and an internal volume;

a spindle disposed centrally within said internal volume;

an opening in said perimeter sidewall;

a hingable door over said opening in said perimeter sidewall;

a plurality of cutting thread lengths connected to one another and wound about said spindle;

said cutting thread lengths comprising a first end and a second end;

a pull tab disposed on said first end of said cutting thread lengths;

a trimmed section disposed on said second end;

wherein said trimmed section connects said second end to a pull tab on said first end of a subsequent cutting thread length;

gripping teeth disposed on said hingable door along a distal end of an interior surface thereof;

wherein said gripping teeth are configured to pinch an exposed cutting thread length.

2. The cake cutting tool of claim 1, wherein said spool housing comprises a circular shape.

3. The cake cutting tool of claim 1, wherein said cutting thread lengths are disposable after use.

4. The cake cutting tool of claim 1, wherein said housing upper surface is removable from said housing to expose said interior volume and allow for replacement of cutting thread therein.

5. The cake cutting tool of claim 1, wherein said housing lower surface is removable from said housing to expose said interior volume and allow for replacement of cutting thread therein.

* * * * *